US006089687A

United States Patent [19]

Helterline

[11] Patent Number: 6,089,687

[45] Date of Patent: Jul. 18, 2000

[54] METHOD AND APPARATUS FOR SPECIFYING INK VOLUME IN AN INK CONTAINER

[75] Inventor: Brian L. Helterline, Salem, Oreg.

[73] Assignee: Hewlett-Packard Company, Palo Alto, Calif.

[21] Appl. No.: 09/037,560

[22] Filed: Mar. 9, 1998

[51] Int. Cl.[7] ..... B41J 2/195

[52] U.S. Cl. ..... 347/7

[58] Field of Search ..... 347/7

[56] References Cited

U.S. PATENT DOCUMENTS

| | | | |
|---|---|---|---|
| 4,803,521 | 2/1989 | Honda | 355/14 R |
| 4,961,088 | 10/1990 | Gilliland et al. | 355/206 |
| 5,021,828 | 6/1991 | Yamaguchi et al. | 355/209 |
| 5,049,898 | 9/1991 | Arthur et al. | 346/1.1 |
| 5,138,344 | 8/1992 | Ujita | 346/140 R |
| 5,184,181 | 2/1993 | Kurando et al. | 355/260 |
| 5,272,503 | 12/1993 | LeSueur et al. | 355/208 |
| 5,365,312 | 11/1994 | Hillmann et al. | 355/206 |
| 5,625,384 | 4/1997 | Numata et al. | 347/23 |
| 5,682,184 | 10/1997 | Stephany et al. | 347/7 |
| 5,699,091 | 12/1997 | Bullock et al. | 347/19 |

FOREIGN PATENT DOCUMENTS

| | | | |
|---|---|---|---|
| 0 720 916 | 7/1996 | European Pat. Off. | B41J 2/175 |
| 2316657 | 3/1998 | United Kingdom | B41J 2/175 |
| WO9605061 | 2/1996 | WIPO | B41J 2/175 |

*Primary Examiner*—Fred L Braun

*Attorney, Agent, or Firm*—Kevin B. Sulllivan

[57] ABSTRACT

An ink-jet printing system that includes a printer portion and a replaceable ink container. The printer portion is for depositing ink on media in response to control signals. The printer portion is configured for receiving a supply of ink. The replaceable ink container is for providing a supply of ink to the printer portion. The replaceable ink container includes an electrical storage device for providing parameters to the printer portion. The electrical storage device includes an ink container scale parameter for selecting an ink container volume range from a plurality of ink container volume ranges. Also included is a fill proportion parameter for specifying a fill proportion for the selected ink volume range. The printer portion determines an ink volume associated with the ink container based on the fill proportion parameter and the selected ink volume range. A method of storing ink container parameters in the electrical storage device includes determining the ink container scale and fill proportion parameters. These parameters are then stored on the electrical storage device.

13 Claims, 5 Drawing Sheets

SECTION A-A

CONTROLLER 10
12
14
16
18
20
24
26
28
30
32
34
36
38
40
42
44
46
A
A

METHOD AND APPARATUS FOR SPECIFYING INK VOLUME IN AN INK CONTAINER

BACKGROUND OF THE INVENTION

The present invention relates to ink-jet printing systems that make use of a replaceable printing component. More particularly, the present invention relates to replaceable printing components that include an electrical storage device for providing information to the ink-jet printing system.

Ink-jet printers frequently make use of an ink-jet printhead mounted within a carriage that is moved back and forth across a print media, such as paper. As the printhead is moved across the print media, a control system activates the printhead to deposit or eject ink droplets onto the print media to form images and text. Ink is provided to the printhead by a supply of ink which is either carried by the carriage or mounted to the printing system to not move with the carriage. For the case where the ink supply is not carried with the carriage, the ink supply can be intermittently or continuously connected to the printhead for replenishing the printhead. In either case, the replaceable printing components, such as the ink container and the printhead, require periodic replacement. The ink supply is replaced when exhausted. The printhead is replaced at the end of printhead life.

It is frequently desirable to alter printer parameters concurrently with the replacement of printer components such as discussed in U.S. patent application Ser. No. 08/584,499 entitled "Replaceable Part With Integral Memory For Usage, Calibration And Other Data" assigned to the assignee of the present invention. Patent application Ser. No. 08/584,499 discloses the use of a memory device, which contains parameters relating to the replaceable part. The installation of the replaceable part allows the printer to access the replaceable part parameters to ensure high print quality. By incorporating the memory device into the replaceable part and storing replaceable part parameters in the memory device within the replaceable component the printing system can determine these parameters upon installation into the printing system. This automatic updating of printer parameters frees the user from having to update printer parameters each time a replaceable component is newly installed. Automatically updating printer parameters with replaceable component parameters ensures high print quality. In addition, this automatic parameter updating tends to ensure the printer is not inadvertently damaged due to improper operation, such as, operating after the supply of ink is exhausted or operation with the wrong or non-compatible printer components.

For the case where the printing system is capable of accommodating a plurality of different ink container sizes it is important that size information is transferred between the printer and the ink container in a highly reliable and efficient manner. This exchange of information should not require the intervention of the user thereby ensuring greater ease of use and greater reliability. Furthermore, it is important that the integrity of the information be preserved.

SUMMARY OF THE INVENTION

One aspect of the present invention is an ink-jet printing system that includes a printer portion and a replaceable ink container. The printer portion is for depositing ink on media in response to control signals. The printer portion is configured for receiving a supply of ink. The replaceable ink container is for providing a supply of ink to the printer portion. The replaceable ink container includes an electrical storage device for providing parameters to the printer portion. The electrical storage device includes an ink container scale parameter for selecting an ink container volume range from a plurality of ink container volume ranges. Also included is a fill proportion parameter for specifying a fill proportion for the selected ink volume range. The printer portion determines an ink volume associated with the ink container based on the fill proportion parameter and the selected ink volume range.

Another aspect of the present invention is method for storing ink container parameters in an electrical storage device. The electrical storage device is associated with an ink container containing a volume of ink. The method includes determining an ink scale parameter associated with an ink volume range for the supply of ink. Also included is determining a fill proportion parameter for the supply of ink. Finally, the method includes storing the ink scale and ink fill parameter in the electrical storage device.

DETAILED DESCRIPTION OF THE PREFERRED EMBODIMENT

Figure 1:
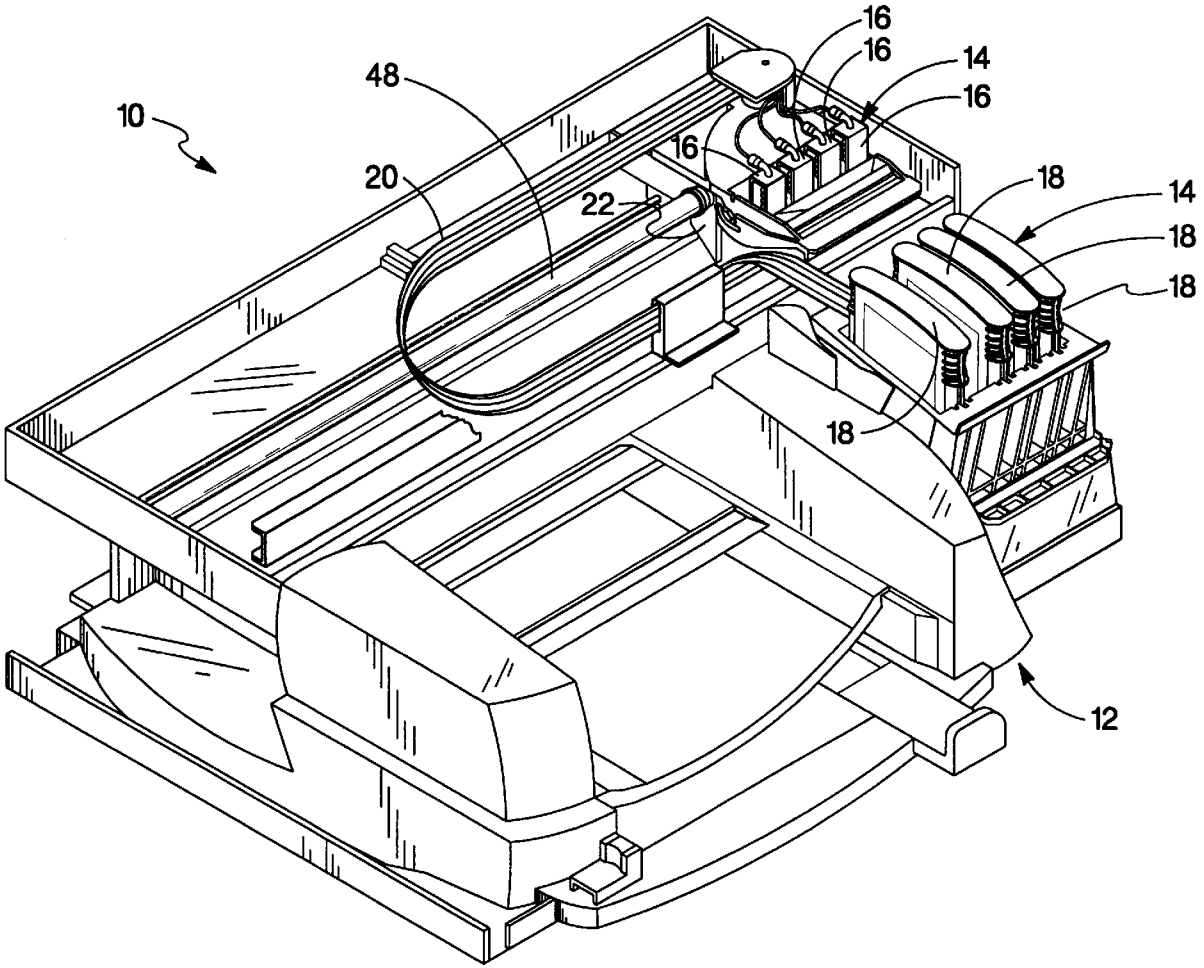
FIG. 1 depicts a perspective view of an exemplary ink-jet printing system, shown with the cover removed, that incorporates removable printing components of the present invention.

FIG. 1 is a perspective view of one exemplary embodiment of an ink-jet printing system 10 of the present invention shown with its cover removed. The ink-jet printing system 10 includes a printer portion 12 having a plurality of replaceable printing components 14 installed therein. The plurality of replaceable printing components 14 include a plurality of printheads 16 for selectively depositing ink in response to control signals and a plurality of ink containers 18 for providing ink to each of the plurality of printheads 16. Each of the plurality of printheads 16 is fluidically connected to each of the plurality of ink containers 18 by a plurality of flexible conduits 20.

Each of the plurality of printheads 16 is mounted in a scanning carriage 22, which is scanned past a print media (not shown) as the print media is stepped through a print zone. As the plurality of printheads are moved relative to the print media, ink is selectively ejected from a plurality of orifices in each of the plurality of printheads 16 to form images and text.

The ink-jet printing system 10 shown in FIG. 1 is configured to receive ink containers 18 having different ink volumes. This is accomplished using several methods, such as, the use of ink containers 18 that are different sizes with each size having a different volume associated therewith. Another technique for providing different ink volumes is to use ink containers 18 of the same size, but vary a volume of ink in each of the ink containers. It is critical that the ink container 18 provides a volume of ink that matches a proper use model for the particular application. Because ink jet inks typically have a limited storage life once inserted into the printer it is important that the ink container be sized sufficiently large to prevent inconveniencing the user with frequent ink container changes and sufficiently small to prevent ink from becoming stale with age. When ink-jet inks have exceeded the storage life and have become stale these inks cannot reliably produce high quality output images.

One aspect of the present invention is a method and apparatus for storing information on the replaceable printing components 14 for updating operation parameters of the printer portion 12. An electrical storage device is associated with each of the replaceable printing components 14. The electrical storage device contains information related to the particular replaceable printer component 14. Installation of the replaceable printing component 14 into the printer portion 12 allows information to be transferred between the electrical storage device and the printing portion 12 to ensure high print quality as well as to prevent the installation of non-compatible replaceable printing components 14. The information provided from the replaceable printing component 14 to the printing portion 12 tends to prevent operation of the printing system 10 in a manner which damages the printing system 10 or which reduces the print quality.

Although the printing system 10 shown in FIG. 1 makes use of ink containers 18 which are mounted off of the scanning carriage 22, the present invention is equally well suited for other types of printing system configurations. One such configuration is one where the replaceable ink containers 18 are mounted on the scanning carriage 22. Alternatively, the printhead 16 and the ink container 18 may be incorporated into an integrated printing cartridge that is mounted to the scanning carriage 22. Finally, the printing system 10 may be used in a wide variety of applications such as facsimile machines, postal franking machines and large format type printing systems suitable for use in displays and outdoor signage.

Figures 2A, 2B:
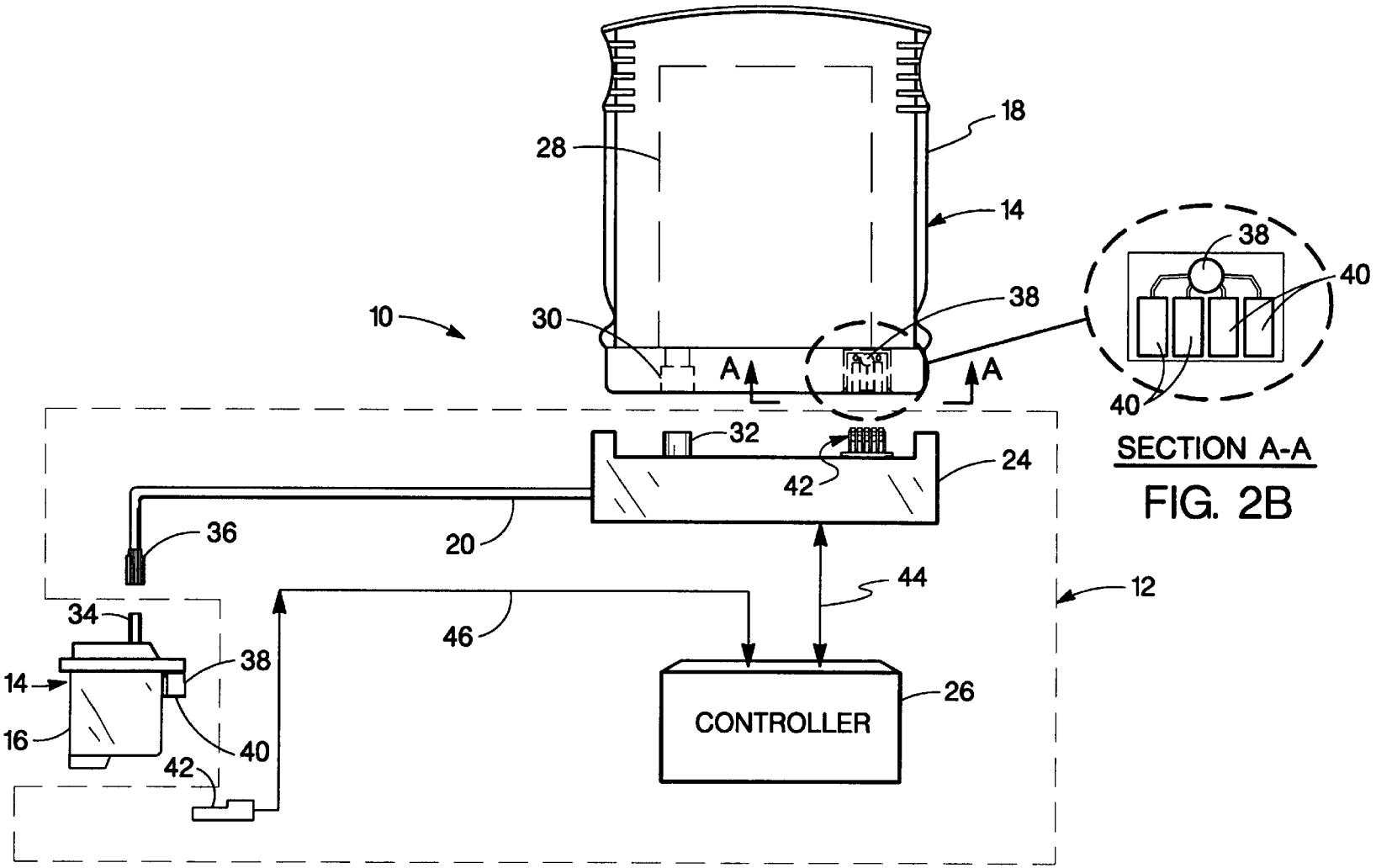
FIGS. 2A and 2B depicts a schematic representation of the ink-jet printing system shown in FIG. 1 illustrating a removable ink container and printhead each of which contain an electrical storage device.

FIGS. 2A and 2B depict a simplified schematic representation of the ink-jet printing system 10 of the present invention shown in FIG. 1. FIGS. 2A and 2B are simplified to illustrate a single printhead 16 and a single ink container 18 for accomplishing the printing of a single color. For the case where more than one color is desired a plurality of printheads 16 are typically used each having an associated ink container 18 as shown in FIG. 1.

The ink-jet printing system 10 of the present invention includes a printer portion 12 having replaceable printing components 14. The replaceable printing components 14 include a printhead 16 and an ink container 18. The printer portion 12 includes an ink container receiving station 24 and a controller 26. With the ink container 18 properly inserted into the ink container receiving station 24, an electrical and a fluidic coupling is established between the ink container 18 and the printer portion 12. The fluidic coupling allows ink stored within the ink container 18 to be provided to the printhead 16. The electrical coupling allows information to be passed between the ink container 18 and the printer portion 12 to ensure the operation of the printer portion 12 is compatible with the ink contained in the ink container 18 thereby achieving high print quality and reliable operation of the printing system 10.

The controller 26 controls the transfer of information between the printer portion 12 and the ink container 18. In addition, the controller 26 controls the transfer of information between the printhead 16 and the controller 26. Finally, the controller 26 controls the relative movement of the printhead 16 and the print media as well as selectively activating the printhead to deposit ink on print media. The controller 26 is typically implemented with a microprocessor or some form of programmable controller.

The ink container 18 includes a reservoir 28 for storing ink therein. A fluid outlet 30 is provided that it is in fluid communication with the fluid reservoir 28. The fluid outlet 30 is configured for connection to a complimentary fluid inlet 32 associated with the ink container receiving station 24.

The printhead 16 includes a fluid inlet 34 configured for connection to a complimentary fluid outlet 36 associated with the printing portion 12. With the printhead 16 properly inserted into the scanning carriage 22 (shown in FIG. 1) fluid communication is established between the printhead and the ink container 18 by way of the flexible fluid conduit 20.

Each of the replaceable printing components 14 such as the printhead 16 and the ink container 18 include an information storage device 38 such as an electrical storage device or memory 38 for storing information related to the respective replaceable printer component 14. A plurality of electrical contacts 40 are provided, each of which is electrically connected to the electrical storage device 38. With the ink container 18 properly inserted into the ink container receiving station 24, each of the plurality of electrical contacts 40 engage a corresponding plurality of electrical contacts 42 associated with the ink container receiving station 24. Each of the plurality of electrical contacts 42 associated with the ink container receiving station 24 are electrically connected to the controller 26 by a plurality of electrical conductors 44. With proper insertion of the ink container 18 into the ink container receiving station 24, the memory 3 8 associated with the ink container 18 is electrically connected to the controller 26 allowing information to be transferred between the ink container 18 and the printer portion 12.

Similarly, the printhead 16 includes an information storage device 38 such as an electrical storage device associated therewith. A plurality of electrical contacts 40 are electrically connected to the electrical storage 38 in a manner similar to the electrical storage device 38 associated with the ink container 18. With the printhead 16 properly inserted into the scanning carriage 22 the plurality of electrically contacts 40 engage a corresponding plurality of electrical contacts 42 associated with the printing device 12. Once properly inserted into the scanning carriage, the electrical storage device 38 associated with the printhead 16 is electrically connected to the controller 26 by way of a plurality of electrical conductors 46.

Although electrical storage devices 38 associated with each of the ink container 18 and the printhead 16 are given the same element number to indicate these devices are similar, the information stored in the electrical storage device 38 associated with the ink container 18 will, in general, be different from the information stored in the electrical storage device 38 associated with the printhead 16. Similarly, the information stored in electrical storage device 38 associated with each ink container of the plurality of ink containers 18 will in general be different and unique to the particular ink container of the plurality of ink containers 18. The particular information stored on each electrical storage device 38 will be discussed in more detail later.

Figure 3:
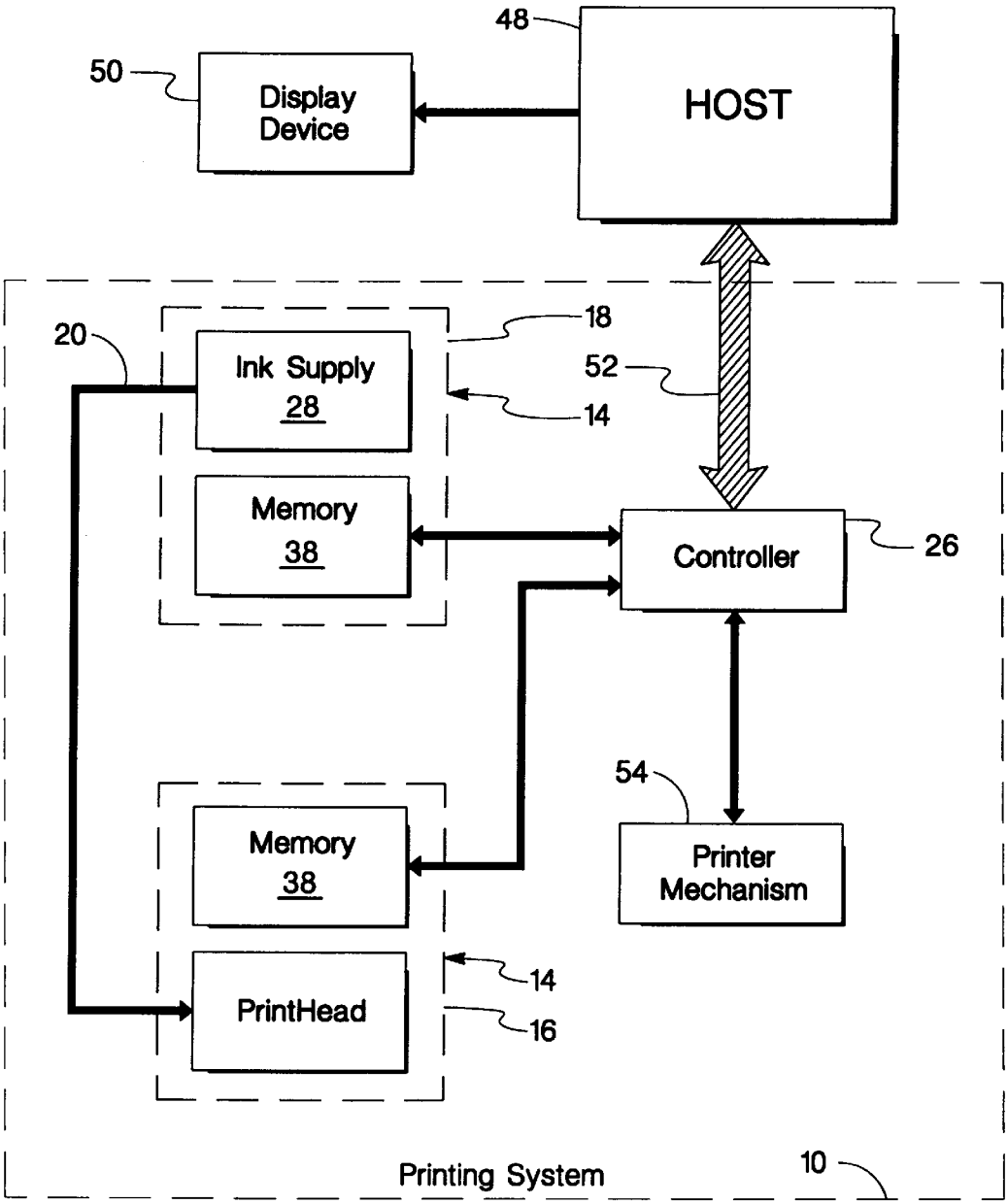
FIG. 3 depicts a schematic block diagram of the ink-jet printing system of FIG. 1 shown connected to a host and which includes a removable ink container and printhead each of which contain the electrical storage device.

FIG. 3 represents a block diagram of the printing system 10 of the present invention shown connected to an information source or host computer 48. The host computer 48 is shown connected to a display device 50. The host 48 can be a variety of information sources such as a personal computer, work station, or server to name a few, that provides image information to the controller 26 by way of a data link 52. The data link 52 may be any one of a variety of conventional data links such as an electrical link or an infrared link for transferring information between the host 48 and the printing system 10.

The controller 26 is electrically connected to the electrical storage devices 38 associated with each of the printhead 16 and the ink container 18. In addition, the controller 26 is electrically connected to a printer mechanism 54 for controlling media transport and movement of the carriage 22. The controller 26 makes use of parameters and information provided by the host 48, the memory 38 associated with the ink container 18 and memory 38 associated with the printhead 16 to accomplish printing.

The host computer 48 provides image description information or image data to the printing system 10 for forming images on print media. In addition, the host computer 48 provides various parameters for controlling operation of the printing system 10, which is typically resident in printer control software typically referred to as the "print driver". In order to ensure the printing system 10 provides the highest quality images it is necessary that the operation of the controller 26 compensate for the particular replaceable printer component 14 installed within the printing system 10. It is the electric storage device 38 that is associated with each replaceable printer component 14 that provides parameters particular to the replaceable printer component 14 that allows the controller 26 to utilize these parameters to ensure the reliable operation of the printing system 10 and ensure high quality print images.

Among the parameters, for example which can be stored in electrical storage device 38 associated with the replaceable printing component 14 are the following: actual count of ink drops emitted from the printhead 16; a date code associated with the ink container 18; date code of initial insertion of the ink container 18; system coefficients; ink type/color: ink container size; age of the ink; printer model number or identification number; cartridge usage information; just to name a few.

The electrical storage device 38 shown in FIGS. 2A and 2B is a four terminal device. Alternatively, the electrical storage device 38 can be a two terminal device. One such two terminal device includes a power and ground terminals. Clock signals and data signals are provided on the power terminal. An example of such a two terminal memory device is a 1K Bit read/write Electrically Programmable Read Only Memory (EPROM) such as the Dallas Semiconductor part number DS 1982, manufactured by the Dallas Semiconductor Corporation.

The technique of the present invention allows ink volume information to be passed between the replaceable consumable 14 and the controller 26 in an efficient and reliable manner. It is frequently desirable to pass very accurate ink volume information between the replaceable consumable 14 and the controller 26. For example, in the case where the replaceable consumable 14 is the ink container 18 it is necessary to have accurate ink volume information associated with the ink supply 28 passed to the controller 26 when the ink container 18 is initially inserted into the printing system 10. This information is used by the printing system 10 to compute remaining ink in the ink supply 28 based on ink usage. Therefore, it is critical that very accurate ink volume information be associated with the ink supply 28 and that this information is accurately provided to the controller 26. The controller 26 uses this ink volume information as a basis for determining an out-of-ink condition. It is important that this out-of-ink condition be determined accurately such that the printer is not operated without ink. Operation of the printer without ink can cause reliability problems or, if long enough, produce catastrophic failure.

The technique of the present invention must not only be capable of providing accurate ink volume information but also capable of providing accurate ink volume information over a large ink volume range. The ink volume range varies with the particular printing application. For example, large format printing requires ink containers that are typically several liters in size as a convenience to the user. Significantly smaller ink containers would require greater frequency of ink container replacement which if frequent enough can be an inconvenience to the user.

In the case of a desktop printer application for home use the ink container 18 may contain a significantly lower volume of ink on the order of 100 cubic centimeters (cc's) or less. Ink containers of larger volume for this application would likely exceed their shelf life or storage period thereby resulting in reduced print quality. In addition, ink use rate for a given application depends on the particular usage for the individual user.

Figure 4:
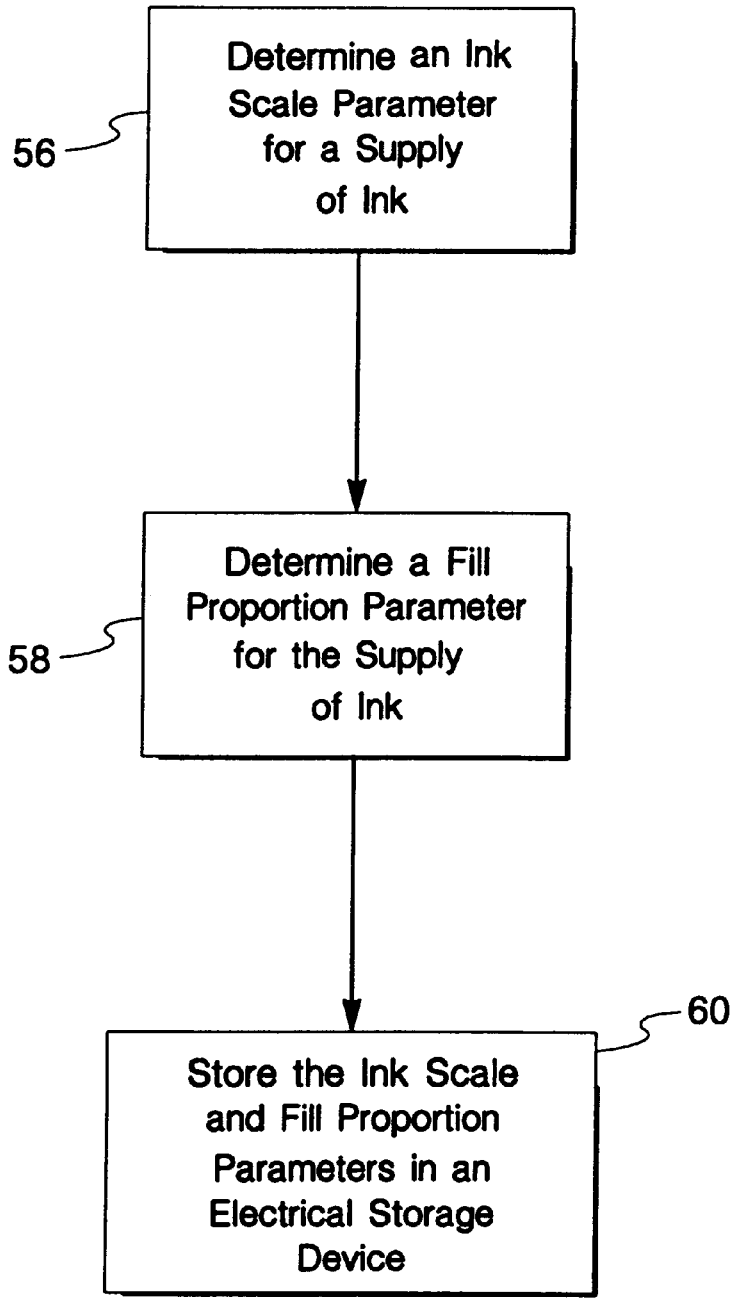
FIG. 4 depicts a block diagram representation of a method of the present invention for determining an ink volume associated with the removable ink container of the present invention and storing this information in an electrical storage device.

FIG. 4 depicts the technique of the present invention for storing ink volume information in the electrical storage device 38. An ink scale parameter is first determined for the ink volume associated with the ink container 18 as represented by step 56. The ink scale parameter identifies an ink container volume range from a plurality of ink container volume ranges. For example, in the preferred embodiment for ink container volume ranges are used as shown in Table 1. The ink container scale parameter is a two-bit binary value that is used to uniquely identify each of the four ink container volume ranges. For example, the two-bit binary value of 00 represents an ink container volume range from 0–255.75 cubic centimeters (cc's). Similarly an ink container scale parameter value equal to 11, binary, represents an ink container volume range from 0–2,046 cubic centimeters.

TABLE 1

| Ink Container Scale Parameter | Ink Container Volume Ranges In cc's | Resolution For 10 Bit Fill Proportion Parameter In cc's |
|---|---|---|
| 00 | 0.00 to 255.75 | 0.25 |
| 01 | 0.00 to 511.50 | 0.50 |
| 10 | 0.00 to 1023 | 1.0 |
| 11 | 0.00 to 2046 | 2.0 |

A fill proportion parameter is then determined for the supply of ink for the ink container 18 as represented by step 58. The fill proportion parameter identifies the proportion of the selected ink container volume range that represents the ink volume associated with the ink container 18. In the preferred embodiment the fill proportion parameter is a 10-bit binary value. This 10-bit binary value can uniquely identify up to $2^{10}$ or 1,024 unique values. An ink volume resolution associated with the ink container 18 then varies with the ink container volume range. For example, the resolution is represented by a maximum ink container volume in the ink container range divided by the number of the unique fill proportion parameter values. For example, for the ink container volume range 0–255.75 shown in table 1 the ink volume resolution is equal to 255.75 divided by 1,024 or approximately 0.25 cubic centimeters as shown in Table 1. Therefore, the accuracy in which the fill proportion parameter can specify the ink container volume when the ink scale parameter value selected is equal to 00 selected is 0.25 cubic centimeters. In the case where the ink container scale parameter value is 11 binary representing a much larger ink container volume range (0–2,046) then the resolution of the fill proportion parameter is 2.0 cubic centimeters. The ink scale and the fill proportion parameters are then stored in the electrical storage device 38 associated with the ink container 18 as represented by step 60.

Figure 5:
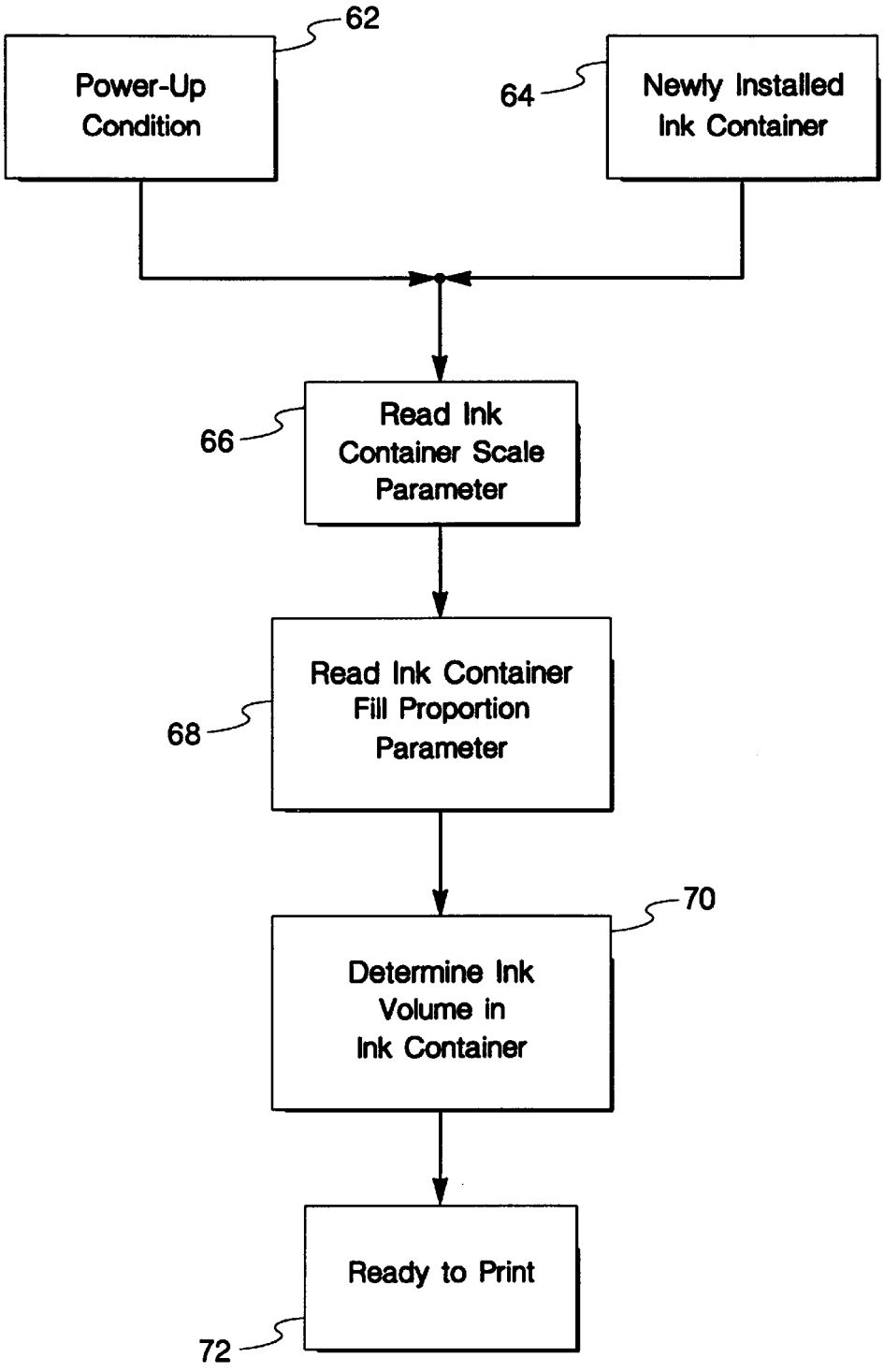
FIG. 5 depicts a block diagram representation of a method of the present invention for determining an ink volume associated with the removable ink container of the present invention.

FIG. 5 depicts a method for reading the contents of the electrical storage device 38 that has an indeterminate size prior to insertion into the printing system 10. As discussed previously, the printing system 10 is capable of accepting ink containers 18 that have varying ink container volumes. The technique of the present invention allows the particular ink volume associated with the ink container 18 to be accurately specified using minimal resources in the electrical storage device 38.

In operation, the printing system when powered up represented by step 62 or when the ink container 18 is newly installed represented by step 64 a memory read request represented by steps 66 and 68 is initiated by the controller 26. This read request directs the electrical storage device 38 to provide the ink container scale parameter and the fill proportion parameter to the controller 26. The controller 26 interprets this information to determine the volume of ink associated with the ink container 18 as represented by step 70. The printing system 10 is then ready for accepting a print command from the host as represented by step 72.

The technique of the present invention allows large ink volumes to be accommodated while providing improved resolution when low ink volume ranges are used. For example, for the case where the ink container scale parameter and the fill proportion parameter are combined into a single twelve bit binary value representing ink volume associated with the ink container 18 then there are $2^{12}$ unique values or 4,096 unique values to specify ink volume. Dividing the maximum ink volume the system must accommodate or 2,046 cc's by the number of unique values or 4,096 yields the ink volume resolution that is approximately 0.5 cubic centimeters. In contrast, the technique of the present invention allows a resolution of 0.25 for low ink container volume ranges thereby providing improved resolution by a factor of 2 for the low ink container volume range. This improvement in resolution at the low volume range is accomplished without requiring additional information i.e. 12 total bits of information. The improvement in resolution is greatest for the low ink container volume ranges. The resolution where resolution is most important is actually decreased slightly for the high ink container volume range. This improvement in the low ink container volume range becomes more dramatic the greater the difference in ink container volume range between the highest range and the lowest range.

Although the present invention has been described with respect to the preferred embodiment where the replaceable printing components are the printhead portion 16 mounted on the print carriage 22 and the ink container 18 mounted off of the print carriage 22 the present invention is suited for other printer configurations as well. For example, the printhead portion and the ink container portion may each be mounted on the printing carriage 22. For this configuration each of the printhead portion and the ink container portion are separately replaceable. Each of the printhead portion and the ink container includes an electrical storage portion 38 for providing information to the printing portion 12. Each ink container of a plurality of ink containers may be separately replaceable or replaceable as an integrated unit. For the case where the plurality of ink containers is integrated into a single replaceable printing component then only a single electrical storage portion 38 is required for this single replaceable printing component.

What is claimed is:

1. An ink-jet printing system comprising:

a printer portion for depositing ink on media in response to control signals, the printer portion configured for receiving a supply of ink;

a replaceable ink container for providing a supply of ink to the printer portion, the replaceable ink container including an electrical storage device for providing parameters to the printer portion, the electrical storage device containing:

an ink container scale parameter for selecting an ink container volume range from a plurality of ink container volume ranges, a fill proportion parameter for specifying a fill proportion for the selected ink volume range;

wherein the printer portion determines an ink volume associated with the ink container based on the fill proportion parameter and the selected ink volume range.

2. The ink-jet printing system of claim 1 wherein the ink container scale parameter is a two bit binary value.

3. The ink-jet printing system of claim 1 wherein the fill proportion parameter is a 10 bit binary value specifying a proportion of the selected ink volume range.

4. The ink-jet printing system of claim 1 wherein the printer portion contains the plurality ink volume ranges with each of the plurality of ink volume ranges having a plurality of corresponding ink container volume scale parameters associated therewith.

5. The ink-jet printing system of claim 1 wherein the replaceable ink container includes an electrical storage device wherein the electrical storage device contains the ink fill proportion parameter and the ink container scale parameter.

6. An ink container for providing ink to an ink-jet printer, the ink container comprising:

a reservoir containing a supply of ink; and an electrical storage device for providing ink container parameters to the ink-jet printer, the electrical storage device containing:

an ink scale parameter for selecting an ink volume range from a plurality of ink volume ranges; and a fill proportion parameter for specifying a fill proportion for the selected ink volume range associated with the supply of ink in the reservoir;

wherein an ink volume associated with the supply of ink within the reservoir is determinable based on the fill proportion parameter and the ink scale parameter.

7. The ink container of claim 6 wherein the ink scale parameter is a two bit binary value and wherein the fill proportion parameter is a 10 bit binary value specifying a proportion of the selected ink volume range.

8. The ink container of claim 6 further including a printer portion for depositing ink on media in response to control signals, the printer portion configured for receiving the ink container and determining the ink volume based on the ink scale parameter and the fill proportion parameter.

9. An electrical storage device for use with an ink container for providing information to an ink-jet printer related to an ink volume associated with the ink container, the electrical storage device comprising:

an ink scale parameter for selecting an ink volume range from a plurality of ink volume ranges; and a fill proportion parameter for specifying a fill proportion for the selected ink volume range;

wherein the ink volume associated with the ink container is determinable based on the fill proportion parameter and the ink scale parameter.

10. The electrical storage device of claim 9 wherein the ink scale parameter is a two bit binary value and wherein the fill proportion parameter is a 10 bit binary value specifying a proportion of the selected ink volume range.

11. A method for storing ink container parameters in an electrical storage device, the electrical storage device associated with an ink container containing a volume of ink, the method comprising:

determining an ink scale parameter associated with an ink volume range for the supply of ink;

determining a fill proportion parameter for the supply of ink; and storing the ink scale and ink fill parameter in the electrical storage device.

12. The method of claim 11 further including installing the ink container into an ink-jet printer establishing an electrical interconnect between the ink-jet printer and the electrical storage device.

13. The method of claim 12 further including transferring the ink scale parameter and the fill proportion parameter from the electrical storage device to the ink-jet printer, the ink-jet printer determining the volume of ink associated with the ink container based on the ink scale parameter and the fill proportion parameter.

* * * * *

UNITED STATES PATENT AND TRADEMARK OFFICE

CERTIFICATE OF CORRECTION

PATENT NO. : 6,089,687
DATED : July 18, 2000
INVENTOR(S) : Brian L. Helterline

It is certified that error appears in the above-identified patent and that said Letters Patent is hereby corrected as shown below:

Title page,
Second column,
Line 6, "Kevin B. Sulllivan" should read -- Kevin B. Sullivan --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*